US005360058A

United States Patent [19]

Koeppl et al.

[11] Patent Number: 5,360,058

[45] Date of Patent: Nov. 1, 1994

[54] HEAT PIPE FOR TRANSFERRING HEAT

[75] Inventors: Alois Koeppl; Robert Mueller, both of Moordeich, Germany

[73] Assignee: ERNO Raumfahrttechnik GmbH, Bremen, Germany

[21] Appl. No.: 90,334

[22] Filed: Jul. 8, 1993

[30] Foreign Application Priority Data

Jul. 8, 1992 [DE] Germany ..... 4222340

[51] Int. Cl.[5] ..... F28D 15/02

[52] U.S. Cl. ..... 165/104.26; 165/104.27; 165/32; 122/366

[58] Field of Search ..... 165/104.26, 32, 96, 165/104.27; 122/366

[56] References Cited

U.S. PATENT DOCUMENTS 3,537,514 11/1970 Levedahl ..... 165/104.26

4,422,501 12/1983 Franklin et al. ..... 165/104.26

FOREIGN PATENT DOCUMENTS 63492 4/1984 Japan ..... 165/96

OTHER PUBLICATIONS

Heat Pipe Design Handbook; vol. 1, B & K Engineering Inc.; Towson, MD 21204; USA: pp. 149 and 152.

*Primary Examiner*—Albert W. Davis, Jr.

*Attorney, Agent, or Firm*—W. G. Fasse; W. F. Fasse

[57] ABSTRACT

A heat pipe has at least one liquid flow channel and one vapor flow channel for the movement of the heat carrier fluid from the evaporator end to the condenser end and vice versa. The liquid flow channel is so constructed that the capillary radius of its cross-sectional area increases from the evaporator end to the condenser end of the heat pipe, preferably in a continuous manner. Further, the evaporator end of the pipe is provided with a closure member for communicating the liquid flow channel with the vapor flow channel for replenishing the liquid in the evaporating end if necessary. Opening of the closure member also permits gas and/or vapor bubbles that have been collected in the liquid flow channel to pass into the vapor channel. The closure member may be operated by an electromagnetic valve.

12 Claims, 2 Drawing Sheets

HEAT PIPE FOR TRANSFERRING HEAT

FIELD OF THE INVENTION

The invention relates to a heat pipe for transferring heat, for example for cooling the interior of a spacecraft. Such heat pipes are filled with a heat carrier or heat transfer medium or fluid that is evaporated at the hot end of the heat pipe and condensed again at the cool end of the heat pipe.

BACKGROUND INFORMATION

Conventional heat pipes comprise at least two fluid ducts. The liquid phase of the heat carrier flows from the cool end to the hot end. The evaporated phase of the heat carrier flows from the hot end to the cool end. The first mentioned channel is referred to as the liquid channel. The second channel is referred to as the vapor channel. Means may be provided for transporting bubbles that may be present in the liquid channel into the vapor channel.

Such heat pipes for the transport of heat are particularly useful in space technology. The heat carrier is normally ammonia which is evaporated at the heat absorbing end of the pipe and the vapor is transported to the heat discharging end of the pipe which is the condenser end, whereby the heat given off by the vapor as it is being condensed is discharged to the environment. The condensate or liquid flows back again to the evaporator end of the pipe by capillary action. The vapor flow from the evaporator end to the condenser end is maintained by a pressure difference between these two ends whereby the vapor flow is a pressure flow. Different radii of curvature along the boundary surface or wall between the liquid channel and the vapor channel at the evaporator end on the one hand, and at the condenser end on the other hand, and the capillary forces caused thereby impose a pressure difference in the direction toward the evaporator end and this pressure difference maintains the flow. The resulting flow velocity depends on the equilibrium that is established between the pressure loss due to frictional forces and the effective capillary forces.

Modern high performance heat pipes are capable of transporting substantial heat quantities over substantial distances even at relatively small temperature differences between the hot, evaporating end, and the cold or condensing end of the heat pipe. For example, one kilowatt can be easily transported over distances from 1 to about 20 m. Higher heat quantities have been transported over shorter distances.

Comparing conventional high performance heat pipes with other conventional heat pipes, the higher performance of the former is achieved in that the transport of the liquid takes place through channels of differing dimensions. In the vaporization zone a multitude of very small channels having geometries for capillary action are used in order to achieve substantial driving capillary forces. In the condensating zone and in the section between the evaporating and condensing zones, namely in the transport zone, the transport takes place through few flow channels and if suitable even in a single channel with a relatively large diameter. Such a large diameter channel may also be referred to as an artery. The just described structure minimizes pressure losses due to frictional forces. As a result, a substantially increased fluid mass flow is achieved even though the capillary forces remain the same. Simultaneously, a substantially increased heat transfer or heat flow is achieved due to the improved mass flow.

In operating such high performance heat pipes, however, a substantial problem is encountered. Such a problem is caused by vapor bubbles of the heat carrier fluid or by gaseous noncondensible foreign matter. Bubbles and noncondensible matter impair the function of a heat pipe substantially or may even interrupt the operation. Such bubbles or foreign matter may have been present inside the heat pipe already at the time of starting the operation and their presence may have been completely accidental. Such impairments may also be caused by an operational overloading of the heat pipe, for example, by superheating the evaporation end of the pipe causing a short duration, temporary drying of the evaporation zone. Resulting bubbles can interrupt the transport of the heat carrier fluid to the hot end of the pipe so that the hot end even dries further, thereby blocking the further function of the heat pipe.

Two conventional heat pipes are described in "Heat Pipe Design Handbook", Volume 1, by B+K Engineering Incorporated, Towson, Md., 21204 (U.S.A.), pages 149 and 152. These conventional heat pipes include devices for the removal of bubbles and thus avoiding the blockage of the desired flow by the gas bubbles. In one instance, gas bubbles are avoided by venting bores in the separation wall between the artery and the vapor channel. In the other instance, the gas bubbles are avoided by a suction nozzle arranged in the transport area for the vapor. The suction nozzle functions simultaneously as a jet pump for sucking off gas bubbles in the artery through a suction pipe.

The arrangement of venting holes in the wall of the artery has the disadvantage that during the operation of the heat pipe the pressure in the vapor channel is substantially higher than in the artery so that for transferring gas bubbles out of the artery into the vapor channel, the operation of the heat pipe must be interrupted. However, during such interruption the venting bores are blocked by liquid bridges which must first evaporate before the gas bubbles can pass through the venting bores. As a result, such interruptions of the operation of the heat pipe require relatively long time periods before the heat pipe can become operational again.

With regard to the second conventional devices for the removal of bubbles by a suction nozzle or venturi nozzle, there is the disadvantage that, in case there is no gas bubble within the suction range of the suction nozzle, a small quantity of heat carrier fluid is collected from the artery into the suction pipe. If now a gas bubble does appear in front of the suction inlet, it is necessary to first suck in the liquid quantity out of the suction pipe to be able to also remove the gas bubble. The result is a substantial pressure loss in the flow in the suction pipe. As a result, the pressure reduction caused thereby in the suction nozzle is correspondingly substantial. Thus, the nozzle must have a relatively large reduction in the cross-sectional flow area. Such a reduction in turn leads to a substantial impairment of the vapor flow, due to the pressure loss and thus to a substantially reduced effectiveness of the heat pipe.

OBJECTS OF THE INVENTION

In view of the foregoing it is the aim of the invention to achieve the following objects singly or in combination:

to construct a heat pipe of the type described in such a manner that vapor bubbles of the heat carrier fluid and bubbles of a noncondensible gas are reliably, simply, and quickly removed from the flow channel of the fluid to assure that operation of the heat pipe can be started with certainty;

to make sure that initial starting of the heat pipe or a restarting of the heat pipe following a shut-down due to an overload is safely and quickly possible;

to provide a heat pipe that is not sensitive to overloads that may occur during its operation;

to efficiently remove bubbles from the fluid regardless whether these bubbles are noncondensible gases or vapor bubbles of the heat carrier fluid; and to provide for a quick venting of the heat pipe either manually or automatically by temporarily opening one end of the heat pipe, preferably the evaporation end to communicate temporarily the liquid channel with the vapor channel.

SUMMARY OF THE INVENTION

The above objects have been achieved according to the invention by a heat pipe which is characterized in that it has a single liquid flow channel and one single vapor channel communicating the condenser end with the evaporator end, and the evaporator end with the condenser end respectively, wherein the liquid channel has a capillary radius that increases from the evaporating end toward the condensing end of the heat pipe. Such an increase of the capillary radius may efficiently be accomplished by providing a separation wall that divides the heat pipe into the liquid channel and the vapor channel in such a way that the separation wall is inclined relative to the longitudinal axis of the heat pipe. Preferably, the increase of the capillary radius is continuous from one end to the other.

A heat pipe according to the invention is tolerant toward faults to a substantial degree as far as these faults involve overloads that may occur during operation. This is so because starting or restarting the present heat pipe is substantially simplified and accelerated by the claimed construction of the capillary radius of the liquid channel. It is a special, important advantage of the present heat pipe that bubbles of all kinds can be efficiently removed, including noncondensible gas bubbles as well as vapor bubbles of the heat carrier fluid.

By temporarily opening the evaporator end of the fluid channel in the heat pipe either manually or fully automatically, an efficient venting is accomplished that is substantially accelerated by such opening. The power or force necessary for the temporary opening may be advantageously derived from a thermostatically controlled-source, an. electro-magnetic source, or by using an operating member made of a so-called shape memory alloy, such as a nickel titanium alloy or the like. The operating or drive member may have a temperature responsive shape

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
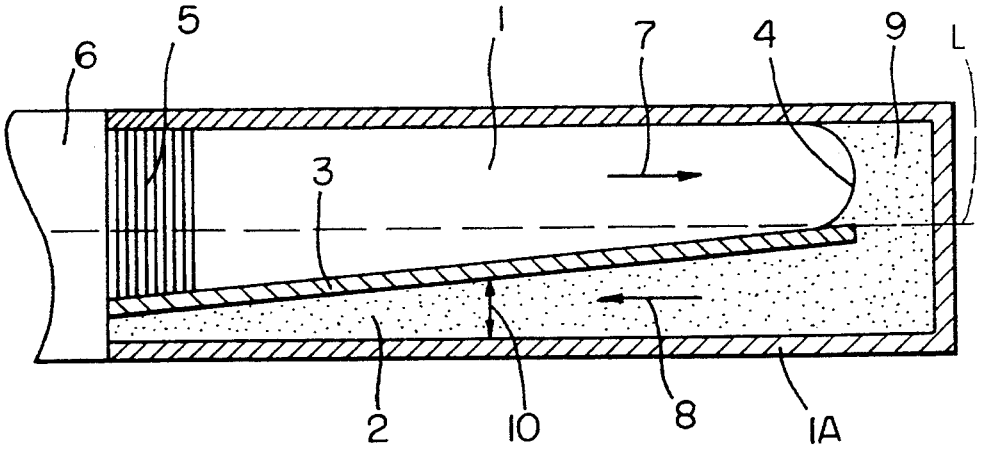
FIG. 1 shows a longitudinal section through a first embodiment of a heat pipe according to the invention, illustrating the evaporator end at the left end of the drawing and the condenser end at the right-hand end of the drawing.

FIG. 1 shows a first embodiment of the heat pipe according to the invention having a tubular hollow housing 1A. The left-hand end 6 of the housing 1A is constructed as the hot or evaporator end of the heat pipe. The right-hand end 9 of the housing 1A forms the cool or condenser end 9 of the heat pipe. According to the invention, the inner space in the housing 1A of the heat pipe is divided by a slanted separator wall 3 into a single vapor flow channel 1 and into a single liquid flow channel 2 as shown in FIG. 1. The evaporator end 6 communicates with the single vapor flow channel 1 through a capillary structure 5 and the vapor flows in the direction of the arrow 7 to the condenser end 9. A boundary surface 4 between the vapor and the liquid is indicated near the right-hand end 9 of the heat pipe. The wall 3 is inclined relative to the longitudinal axis L of the housing 1A in such a manner that the liquid flow channel 2 in which the liquid flows from right to left has a capillary radius 10 that increases, preferably continuously in an uninterrupted manner from left to right, accordingly the radius 10 decrease from right to left. In other words, the cross-sectional flow area of the single liquid flow channel 2 which is also referred to as the artery, increases from the evaporator end 6 toward the condenser end 9. As a result, the cross-sectional flow area of the single vapor flow channel 1 decreased from left to right as seen in FIG. 1.

Due to the just described construction of the liquid flow channel or artery 2 it is assured that gas or vapor bubbles in the liquid flow 8 have a tendency to return to the evaporator end 6 since the flow velocity increases toward the evaporator end 6 from right to left. The capillary structure 5 comprises a plurality of fine capillary ducts extending in a circumferential or tangential direction and communicating the evaporator end 6 with the vapor flow channel 1.

According to the invention, the communication between the left-hand exit end of the liquid flow channel 2 and the left-hand entrance end into the vapor flow channel 1 can be closed off by a closure device 16 shown in FIG. 4 and described in more detail below.

Figure 2:
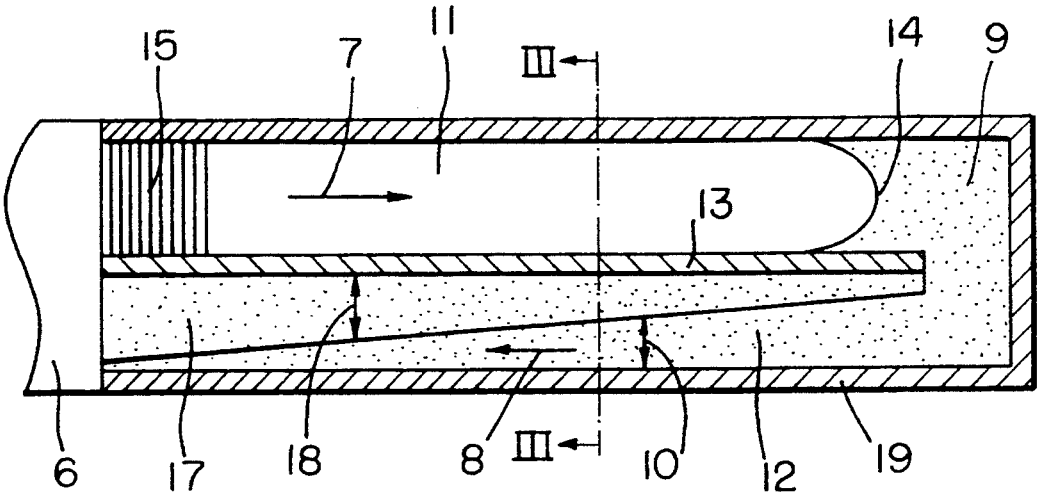
FIG. 2 is a sectional view similar to that of FIG. 1, however showing a modified embodiment.
Figure 3:
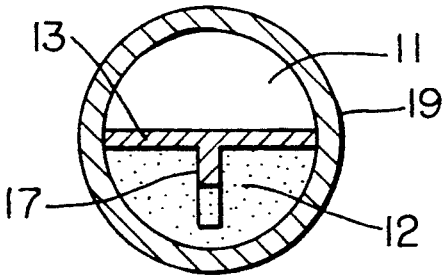
FIG. 3 is a sectional view along section line III—III in FIG. 2.

Referring to FIGS. 2 and 3 in conjunction, these figures show a second embodiment of the invention in which the housing 19 is also divided into a single vapor flow channel 11 and into a single liquid flow channel 12, whereby the separation wall 13 extends centrally and longitudinally through the housing 19 substantially coinciding with the central longitudinal axis of the housing 19. According to the invention, the separation wall 13 has a radially and longitudinally extending wall extension 17 with a radial dimension or depth 18 that diminishes from the evaporator end 6 to the condenser end 9, also preferably in a continuous uninterrupted manner. The evaporator end 6 again communicates with the vapor flow channel 11 through a capillary structure 15 and the boundary wall 14 exists between the vapor in the channel 11 and the liquid in the condenser end 9. This slanted construction of the wall extension 17 of the wall 13, both of which may be made of sheet metal, again assures that the capillary radius 10 of the liquid flow channel 12 gradually or continuously increases from the evaporator left end 6 toward the condenser end 9. As the radial depth 18 of the wall section 17 increases from right to left, the capillary radius 10 correspondingly decreases and vice versa as best seen in FIG. 2. As a result, the cross-sectional flow area of the liquid flow channel 12 in FIG. 2 also increases from the evaporator end 6 to the condenser end 9 just as in the embodiment of FIG. 1. However, in FIG. 2 the cross-sectional flow area of the single vapor flow channel 11 remains constant along the length of the channel.

Figure 4:
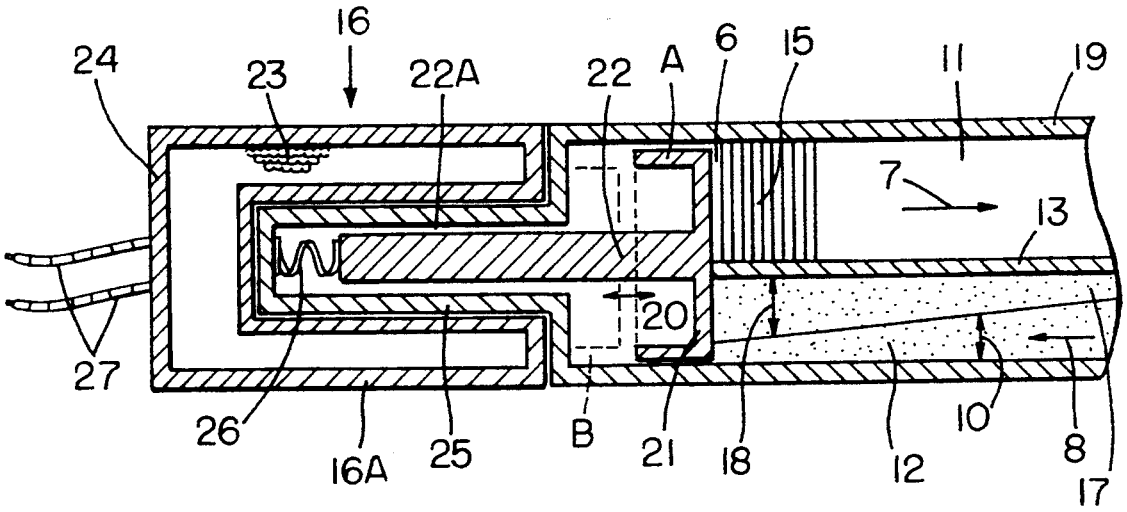
FIG. 4 is a sectional view through the left-hand end structure of a heat pipe according to the invention, illustrating a closure device for communicating the liquid and vapor channels at the evaporator end of the present heat pipes.

Referring to FIG. 4, the heat pipe embodiment shown is the same as in FIGS. 2 and 3, namely with a horizontal separation wall 13 having a downwardly extending wall extension 17 constructed as described above. The left-hand end 6, or rather the communication between the left end of the liquid channel 12 and the left end of the vapor channel 11, can be closed or opened by the closure device 16 including a poppet valve type structure with a poppet head 21 connected to a valve stem 22 guided in a bore 22A of a housing extension 25 of the heat pipe housing 19. The stem 22 functions as an armature of an electromagnet 16A having an electromagnetic coil 23 in a housing 24. The coil 23 is connected through electrical conductors 27 to a controlled energizing source of electrical power for operating the stem 22 and thus the poppet head 21. In the bottom cavity of the housing extension 25 there is a compression spring 26 that biases the valve stem 22 in the direction of the arrow 20 to the right, thereby biasing the poppet head into the closed state in which communication between the channels 12 and 11 is interrupted. When the coil 23 is energized, the valve stem 22 is moved to the left, thereby placing the poppet head 21 into the dashed line position B to open the just mentioned communication. As soon as the power is switched off again, the spring 26 returns the poppet head 21 into the full line position A, thereby closing off the communication between the channels 11 and 12. Thus, the biasing force of the spring 26 and the energizing of the coil 23 move the poppet valve back and forth as indicated by the double arrow 20.

The magnet 16A with the energizing coil 23 may be manually removed from the housing extension 25 for operating the valve. Alternatively, the magnet 16A may remain in place and the power may be switched on or off, for example, in response to a thermostat in the evaporator housing end 6. The housings for 16A, 25 are made of materials that will not interfere with the proper magnetic activation of the valve.

In operation, prior to first activating the heat pipe or following a shut-down due to an overload, the valve is temporarily opened by moving it in the left direction in FIG. 4 to thereby space the popper head 21 from the wall 13. The thus established communication between the channels 11 and 12 permits any vapor and/or gas bubbles that may have collected in the liquid flow channel 12 to pass into the vapor channel 11. This passage can take place rapidly due to the large opening established by the movement of the valve. Thus, the liquid channel 12 again fills completely with the liquid heat carrier fluid, whereby the heat pipe is again ready for operation. The liquid passes through the capillary structure 5, 15 and takes up heat in the evaporator section, whereby the liquid is converted into vapor flowing through the channel 11 toward the condenser end 9. The operation of both embodiments of FIGS. 1 and 2 is the same.

The short duration opening of the above mentioned fluid passage is controlled by energizing the coil 23 through the power supply conductors 27, whereby the stem 22 is pressed to overcome the biasing force of the compression spring 26 in the left-hand end of the guide bore 22A.

Instead of using an electromagnet 16A for the operation of the valve, it is possible to provide an automatic control in response to a thermostat, including an electrical heater and a position adjustment member that is temperature responsive in its shape to move the stem 22 as indicated by the arrow 20. The spring 26 may be replaced by an operating member made of a shape memory alloy, such as a nickel titanium alloy which is known as such. Such a member is temperature responsive and opens the valve when the temperature is too high and closes it again when the temperature falls below a threshold temperature.

Although the invention has been described with reference to specific example embodiments it will be appreciated that it is intended to cover all modifications and equivalents within the scope of the appended claims.

What we claim is:

1. A heat pipe for transmitting heat from a location of higher temperature to a location of lower temperature, comprising a hollow tubular housing including an evaporator end (6), a condenser end (9), and a longitudinal separator wall for separating said hollow tubular housing lengthwise between said evaporator end (6) and said condenser end (9) into a single liquid flow channel (2, 12) and into a single vapor flow channel (1, 11) for a heat carrier fluid in said heat pipe, and wherein said single liquid flow channel (2, 12) has a cross-sectional liquid flow area that increases from said evaporator end (6) toward said condenser end (9) of said heat pipe.

2. The heat pipe of claim 1, wherein said cross-sectional liquid flow area increases steadily from said evaporator end toward said condenser end.

3. The heat pipe of claim 1, wherein said separator wall extends at an inclined angle relative to a longitudinal central axis of said heat pipe with such a slant that said cross-sectional liquid flow area for said liquid flow channel increases toward said condenser end.

4. The heat pipe of claim 1, wherein said separator wall extends in parallel to a longitudinal central axis of said heat pipe, said parallel separator wall comprising a radially extending wall extension (17) extending from said parallel separator wall into said single liquid flow channel (12) in the longitudinal and radial direction of said heat pipe, said wall extension (17) having a radially extending depth (18) that decreases from said vapor end (6) toward said condenser end (9), so that said single liquid flow channel (12) has a cross-sectional liquid flow area that increases from said evaporator end (6) to said condenser end (9).

5. The heat pipe of claim 4, wherein said single vapor flow channel (11) has a cross-sectional flow area that remains constant from said evaporator end (6) to said condenser end (9).

6. The heat pipe of claim 1, further comprising a closure device in said heat pipe at said evaporator end of said heat pipe, and drive means for opening and closing said closure device for communicating or interrupting communication between said liquid flow channel and said vapor flow channel at said evaporator end of said heat pipe.

7. The apparatus of claim 6, wherein said closure member comprises a valve and electromagnetic means for operating said valve.

8. The apparatus of claim 6, wherein said drive means of said closure device comprise a temperature responsive adjustment member having a shape deformable in response to temperature changes, and an electrical heater for energizing said adjustment member to open and close said closure device in response to said temperature changes.

9. The apparatus of claim 6, wherein said drive means of said closure device comprise a drive member made of a shape memory alloy for opening and closing said closure device.

10. The apparatus of claim 9, wherein said shape memory alloy is a nickel titanium alloy.

11. The heat pipe of claim 6, comprising automatic control means (27) for operating said closure device.

12. The heat pipe of claim 1, wherein said single vapor flow channel (1) has a cross-sectional vapor flow area that decreases from said evaporator end (6) to said condenser end (9) as said cross-sectional liquid flow area increases.

* * * * *